US009920491B1

(12) United States Patent
Beckhusen

(10) Patent No.: US 9,920,491 B1
(45) Date of Patent: Mar. 20, 2018

(54) PLATE COMPACTOR WITH INTERCHANGEABLE EDGES

(71) Applicant: Caterpillar Inc., Peoria, IL (US)

(72) Inventor: Jordan R. Beckhusen, Robinson, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/375,981

(22) Filed: Dec. 12, 2016

(51) Int. Cl.
*E01C 19/38* (2006.01)
*E02D 3/046* (2006.01)

(52) U.S. Cl.
CPC ..... *E01C 19/38* (2013.01); *E02D 3/046* (2013.01); *E01C 2301/00* (2013.01)

(58) Field of Classification Search
CPC ..... E01C 19/34; E01C 19/38; E01C 2301/00; E02D 3/046; F16F 15/08
See application file for complete search history.

(56) References Cited

U.S. PATENT DOCUMENTS

| | | | | | |
|---|---|---|---|---|---|
| 2,641,982 | A * | 6/1953 | Harshberger | E01C 19/38 | 172/116 |
| 2,646,729 | A * | 7/1953 | Godenir | E01C 19/34 | 404/133.05 |
| 2,951,427 | A * | 9/1960 | Moir | E01C 19/38 | 404/113 |
| 3,001,458 | A * | 9/1961 | Croucher | E02D 3/02 | 404/133.1 |
| 3,314,341 | A * | 4/1967 | Schulin | E02D 3/046 | 15/49.1 |
| 3,847,498 | A * | 11/1974 | Grane | E02D 3/068 | 404/133.1 |
| 3,909,149 | A | 9/1975 | Century | | |
| 3,917,426 | A | 11/1975 | Wohlwend et al. | | |
| 4,113,403 | A | 9/1978 | Tertinek et al. | | |
| 6,179,520 | B1 | 1/2001 | Cochran | | |
| 6,394,697 | B1 * | 5/2002 | De Boer | E01C 19/38 | 404/133.05 |
| 9,284,695 | B2 * | 3/2016 | Dulieu | E01C 19/34 | |
| 2006/0127190 | A1 * | 6/2006 | Kremer | E01C 19/38 | 405/271 |
| 2009/0035065 | A1 * | 2/2009 | Gavins | E02D 3/074 | 404/114 |
| 2014/0064858 | A1 * | 3/2014 | Paske | E02D 3/046 | 405/271 |
| 2015/0330036 | A1 * | 11/2015 | Dulieu | E01C 19/22 | 404/102 |

FOREIGN PATENT DOCUMENTS

| | | |
|---|---|---|
| DE | 2950081 | 4/1995 |
| DE | 29700432 | 5/1997 |
| EP | 2083123 | 10/2008 |

* cited by examiner

*Primary Examiner* — Abigail A Risic
(74) *Attorney, Agent, or Firm* — Finnegan, Henderson, Farabow, Garrett & Dunner, LLP

(57) ABSTRACT

A vibratory plate compactor includes a vibratory mechanism, a hydraulic motor configured to drive the vibratory mechanism, and a removable baseplate assembly. The removable baseplate assembly includes a planar, central plate configured for compacting earth, and at least one interchangeable edge piece fastened along at least one of a leading edge and a trailing edge of the central plate.

3 Claims, 5 Drawing Sheets

PLATE COMPACTOR WITH INTERCHANGEABLE EDGES

TECHNICAL FIELD

The present disclosure relates to plate compactors and, more particularly, plate compactors with interchangeable edges.

BACKGROUND

Many projects require compacting a surface. For example, various types of construction projects may require compacting surfaces formed by substances like soil, gravel, and asphalt. Various types of specialized machines exist for compacting such surfaces, including, but not limited to, surface rollers and vibrating plates. Such surface compactors operate by applying downward force on the surface with a base of the surface compactor, which base may include, for example, one or more rollers and/or one or more base plates.

Some surface compactors include a vibratory mechanism for generating a fluctuating vertical force on the base of the surface compactor to enhance surface compaction. The results achieved by such a surface compactor may depend in part on the amplitude of the fluctuating vertical force generated by the vibratory mechanism. Accordingly, there exist various control methods for adjusting the magnitude of the fluctuating vertical force to achieve different results. In many existing vibratory compactors, a single base plate is welded to the bottom of the vibratory unit. In some instances, an engine or hydraulic motor controllably rotates at least one eccentric mass to impart vibratory motion at a particular frequency to the base plate. The result is an oscillatory force with the frequency of the speed of rotation, and an amplitude dependent on the mass eccentricity and speed of rotation. Variations on this basic system include multiple eccentric weights and/or shafts such that by changing the phasing of the multiple weights and/or shafts, the degree of force created by the eccentric masses can be varied. Vibratory compactors may also include a removable base plate, such that various sized and shaped base plates may be used with the same vibratory mechanism, and worn or damaged base plates may be readily replaced. In cases where the base plate is removable, a locking mechanism is provided to hold the base plate in place during operation of the vibratory compactor.

Vibratory plate compactor base plates are usually one piece, and are typically a thick plate with formed leading and trailing edges or cast base plates with the leading and trailing edges configured to curve upwards from a remaining flat central portion of the base plate. European Patent EP 2083123 A2 to Schrode ("the EP '123 patent") discloses a vibratory compactor with a removable base plate. In the EP '123 patent a quick-release latch is actuated by a double-acting hydraulic cylinder configured to receive hydraulic fluid from an excavator that operatively carries the vibratory compactor.

Although the EP '123 patent discloses an apparatus and method for removably attaching a base plate to a vibratory compactor, additional benefits and flexibility may be achievable by providing a removable base plate that also includes interchangeable leading and trailing edge pieces configured to be joined along leading and trailing edges of a central, planar, rectangular-shaped base plate. Conventional methods for manufacturing a removable base plate for a vibratory plate compactor generally involve forming a one piece base plate from a relatively thick plate of metal ranging in thickness from approximately 25-30 mm. The removable base plate is formed with a configuration including at least a leading edge that curves upward to allow dirt or other materials being compacted to be guided underneath the base plate as the vibratory plate compactor is moved along the surface. The relatively thick base plate is generally made longer than its final length in order to provide extra material along the leading and trailing edges that can be bent upward and then trimmed to the desired final dimensions for the base plate. This process for forming the base plate results in wasted material, and the process of bending the leading and trailing edges can be a difficult manufacturing operation involving large forces and the inability to precisely control the finished geometry and dimensions of the base plate. Further improvements to vibratory plate compactors may also be achievable by the added flexibility of providing interchangeable edge pieces that may be selectively joined to one or both of the leading and trailing edges of a planar, standardized, rectangular-shaped central plate.

The methods and apparatus for configuring a removable base plate assembly of a vibratory plate compactor with interchangeable leading and trailing edge pieces according to the present disclosure solve one or more of the problems set forth above.

SUMMARY

One aspect of the present disclosure is directed to a vibratory plate compactor including a vibratory mechanism, a hydraulic motor configured to drive the vibratory mechanism, and a removable baseplate assembly. The removable baseplate assembly includes a planar, central plate configured for compacting earth, and at least one interchangeable edge piece fastened along at least one of a leading edge and a trailing edge of the central plate.

Another aspect of the present disclosure is directed to a removable base plate assembly for a vibratory plate compactor. The removable base plate assembly includes a planar, central plate configured for compacting earth, and at least one interchangeable edge piece fastened along at least one of a leading edge and a trailing edge of the central plate.

Yet another aspect of the present disclosure is directed to a method of configuring a base plate assembly for a vibratory plate compactor. The method includes providing a planar, central plate configured for compacting earth, fastening at least one interchangeable edge piece along at least one of a leading edge and a trailing edge of the central plate, and attaching the central plate and at least one interchangeable edge piece to a mounting frame of the vibratory plate compactor.

A still further aspect of the present disclosure is directed to an interchangeable edge piece configured to be joined to a base plate of a vibratory plate compactor. The interchangeable edge piece may include an interface edge, a lower edge, a nose, and an upper edge. The interface edge may have a configuration adapted to mate with at least one of a leading edge and a trailing edge of the base plate, and the lower edge may be configured to extend outward from the interface edge to the nose. The lower edge in conjunction with the nose may be configured to at least one of direct material to be compacted by the vibratory plate compactor underneath the base plate, smooth material compacted by the base plate, or provide a variation to a profile of the at least one of a leading edge and a trailing edge of the base plate.

DETAILED DESCRIPTION

Figure 1:
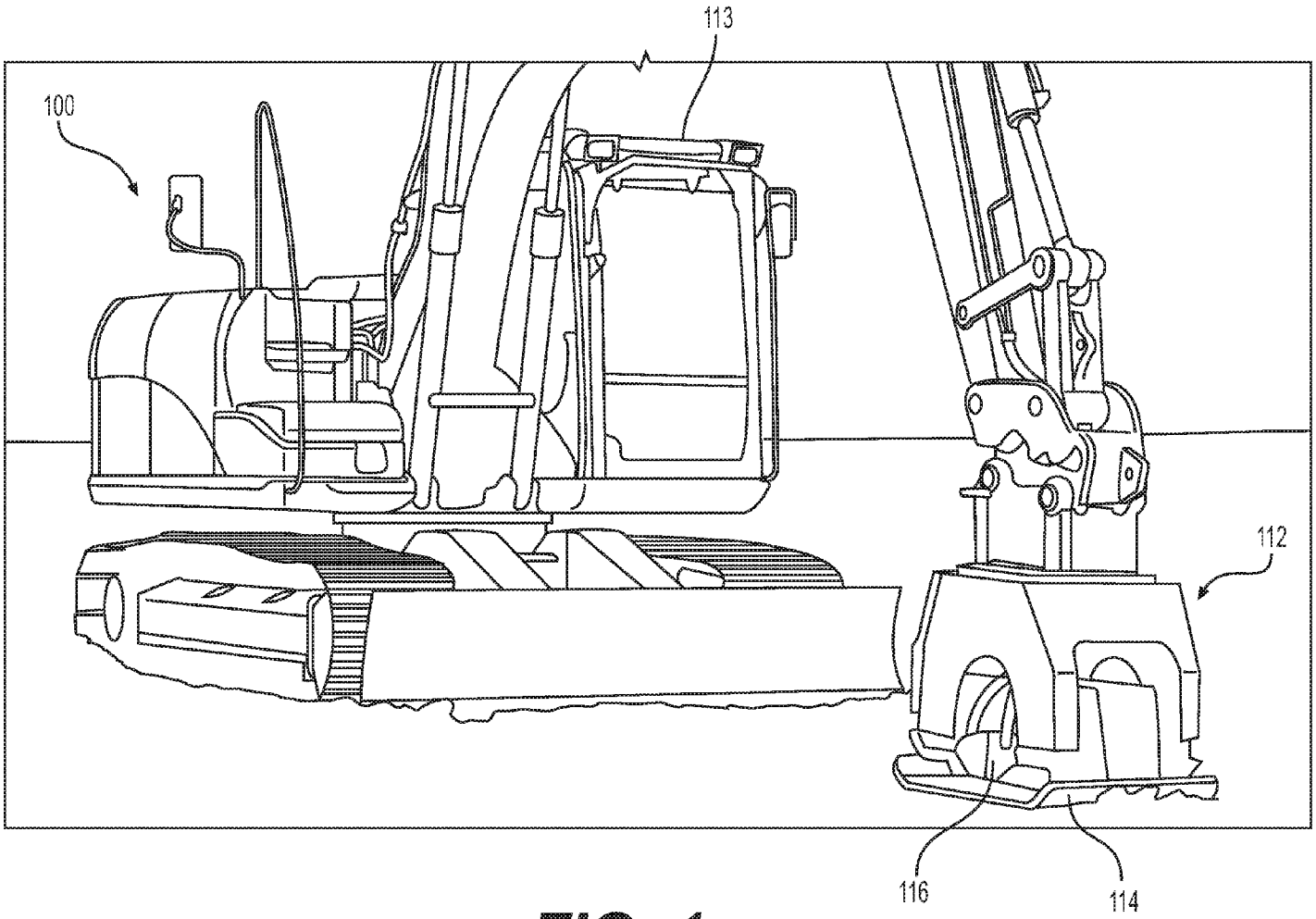
FIG. 1 illustrates one embodiment of a vibratory plate compactor attachment carried by an excavator and including a removable base plate.

FIG. 1 illustrates an excavator 100, including a vibratory compactor attachment 112. The vibratory compactor attachment shown is a vibratory plate compactor, which includes a base plate assembly 114, and one or more vibratory mechanisms 116 configured to actuate the base plate assembly 114 to produce vibration. The vibratory plate compactor 112 may include a hydraulic circuit configured to supply hydraulic fluid to one or more hydraulic motors that power the vibratory mechanisms 116, and to one or more locking actuators configured to lock and unlock the base plate assembly 114 relative to a mounting frame of the vibratory plate compactor 112.

The vibratory plate compactor 112 may be used to compact a variety of densifiable strata. In various alternative implementations, the vibratory plate compactor 112 may be carried by machines other than the excavator shown in FIG. 1, or may be a self-contained unit that is controlled and operated manually or by other means. The source of pressurized hydraulic fluid supplied to the hydraulic circuit of the vibratory plate compactor may be located on the excavator and controlled by an operator, and a solenoid-controlled hydraulic fluid supply valve may be activated by an operator sitting in a cabin 113 of the excavator 100. The operator may activate the hydraulic fluid supply valve to direct the pressurized hydraulic fluid to various hydraulic lines fluidly coupled to the hydraulic circuit for driving the vibratory mechanisms 116. During operation of the vibratory compactor, the operator also operates the boom and stick of the excavator to move the vibratory compactor in a direction parallel to an axis of the vibratory compactor.

The direction of movement of the vibratory plate compactor is generally parallel to an axis of the vibratory compactor extending between and orthogonal to a leading edge and a trailing edge of the base plate assembly 114. In the base plate assembly 114, one or more interchangeable leading edge piece may be joined along the leading edge of a planar, central base plate, and one or more interchangeable trailing edge piece may be joined along the trailing edge of the central base plate. At least one of the interchangeable leading edge piece and the interchangeable trailing edge piece of the base plate assembly 114 is provided with a geometric profile in a plane parallel to the direction of movement of the vibratory plate compactor 112 that contributes to the functionality of the compactor. The geometric profiles of the leading and trailing edge pieces of the base plate assembly 114 serve different purposes depending on the type of material that is being compacted, whether the vibratory compactor is being moved in a forward or rearward direction, and the condition of the surface being compacted.

The vibratory plate compactor 112 according to various exemplary embodiments of this disclosure includes a removable baseplate assembly 114, and the removable baseplate assembly 114 includes a planar, central plate configured for compacting earth or other surface materials. As shown in the exemplary embodiment of FIG. 2, a planar, rectangular-shaped central plate 214 is attached to a mounting frame 220 of the vibratory plate compactor 112. The central plate 214 may be removably attached to the mounting frame 220 of the vibratory plate compactor 112 in various ways, including through the use of removable fasteners, and electrically or hydraulically operated clamping mechanisms associated with the mounting frame 220. In some implementations, an operator of the excavator 100 may engage and release the central base plate of the vibratory plate compactor 112 by changing the direction of flow of hydraulic fluid from a pressurized hydraulic fluid circuit on the excavator to a locking mechanism associated with the mounting frame 220 and the base plate assembly 114.

The central plate 214 may be flame cut or otherwise formed from a steel plate having a thickness that may fall within a range between 20 and 50 mm in thickness. A standard size for the central plate 214 may be determined for a particular vibratory plate compactor 112 or for a variety of models and types of vibratory plate compactors to ensure interchangeability, reduced costs, and manufacturability of the plate. The central plate 214 may be manufactured very inexpensively, with no additional manufacturing steps required after the plate is cut to the desired dimensions. In the exemplary embodiment shown in FIG. 2, an interchangeable leading edge piece 216 is provided along the leading edge of the vibratory plate compactor, and an interchangeable trailing edge piece 218 with substantially the same geometric profile as the leading edge piece 216 is provided along the trailing edge of the compactor. The interchangeable leading and trailing edge pieces may be formed as cast metal parts, machined metal parts, or parts formed using additive manufacturing techniques such as 3D manufacturing of sintered metal materials.

Figure 2:
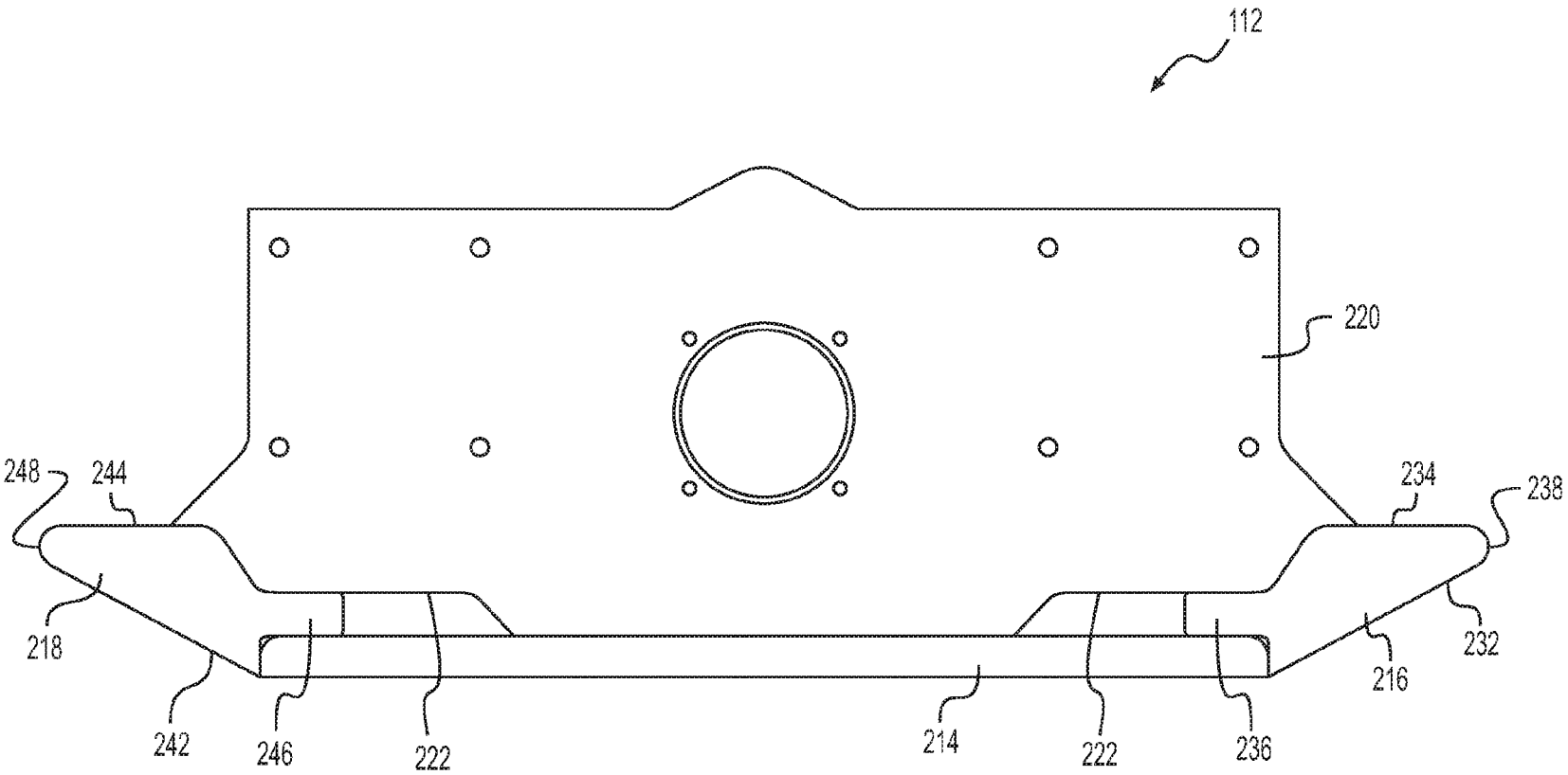
FIG. 2 is a side elevation view of a vibratory plate compactor attachment according to an exemplary embodiment of this disclosure.

As shown in FIG. 2, the geometric profile of each of the leading edge piece 216 and the trailing edge piece 218 results in a lower edge 232 of the leading edge piece 216 and a lower edge 242 of the trailing edge piece 218 sloping upward and outward from the leading and trailing edges of the central plate 214. The lower edge 232 of the leading edge piece 216 merges into a leading edge nose 238 and a flat upper edge 234. An interface edge of the leading edge piece 216 includes an extension 236 of the leading edge piece 216 opposite from the leading edge nose 238. The interface edge of the leading edge piece may be configured to fit in between an upper surface of the central plate 214 and a forward-facing, notched portion 222 of the mounting frame 220. Similarly, the lower edge 242 of the trailing edge piece 218 merges into a trailing edge nose 248 and a flat upper edge 244. An interface edge of the trailing edge piece 218 includes an extension 246 of the trailing edge piece 218 opposite from the trailing edge nose 248. The interface edge of the trailing edge piece 218 may be configured to fit in between an upper surface of the central plate 214 and a rearward-facing, notched portion 222 of the mounting frame 220. One of ordinary skill in the art will recognize that the configuration of the interface edges, the upward slope of the lower edges 232, 242 on the leading and trailing edge pieces 216, 218, and the overall dimensions and configurations of the leading and trailing edge pieces may be varied depending on a number of different factors including the type of material being compacted, the condition of the surface being compacted, any surrounding structures or features such as curbs or buildings against which the compaction is being performed, and other factors. In addition, the leading and trailing edge pieces 216, 218 may be joined to the central base plate 214 to form a base plate assembly before installation on the mounting frame 220 of the vibratory plate compactor 112. Methods of joining the leading and trailing edge pieces 216, 218 to the central base plate 214 may include welding, or the use of readily detachable fasteners such as bolts.

In the exemplary embodiment of FIG. 2, the base plate assembly of the central plate 214 and the leading and trailing edge pieces 216, 218 ensures that dirt or other material being compacted is directed underneath the central plate 214 as the vibratory plate compactor 112 is moved in either a forward or rearward direction (to the left or the right in FIG. 2). An operator of the excavator 100 moves the vibratory plate compactor attachment in the forward and rearward directions parallel to the axis of the compactor attachment as the vibratory mechanism 116 continues to operate to impart a vibratory up-and-down motion to the base plate assembly. Dirt or other material on the surface being compacted is directed underneath the central plate 214 by the leading edge piece 216 as the compactor attachment is moved forward, and by the trailing edge piece 218 as the compactor attachment is moved rearward. The interchangeable leading edge piece 216 may be a single piece or a plurality of pieces extending and joined along substantially the entire length of the leading edge of the central plate 214. Similarly, the interchangeable trailing edge piece 218 may be a single piece or a plurality of pieces extending and joined along substantially the entire length of the trailing edge of the central plate 214.

Figure 3:
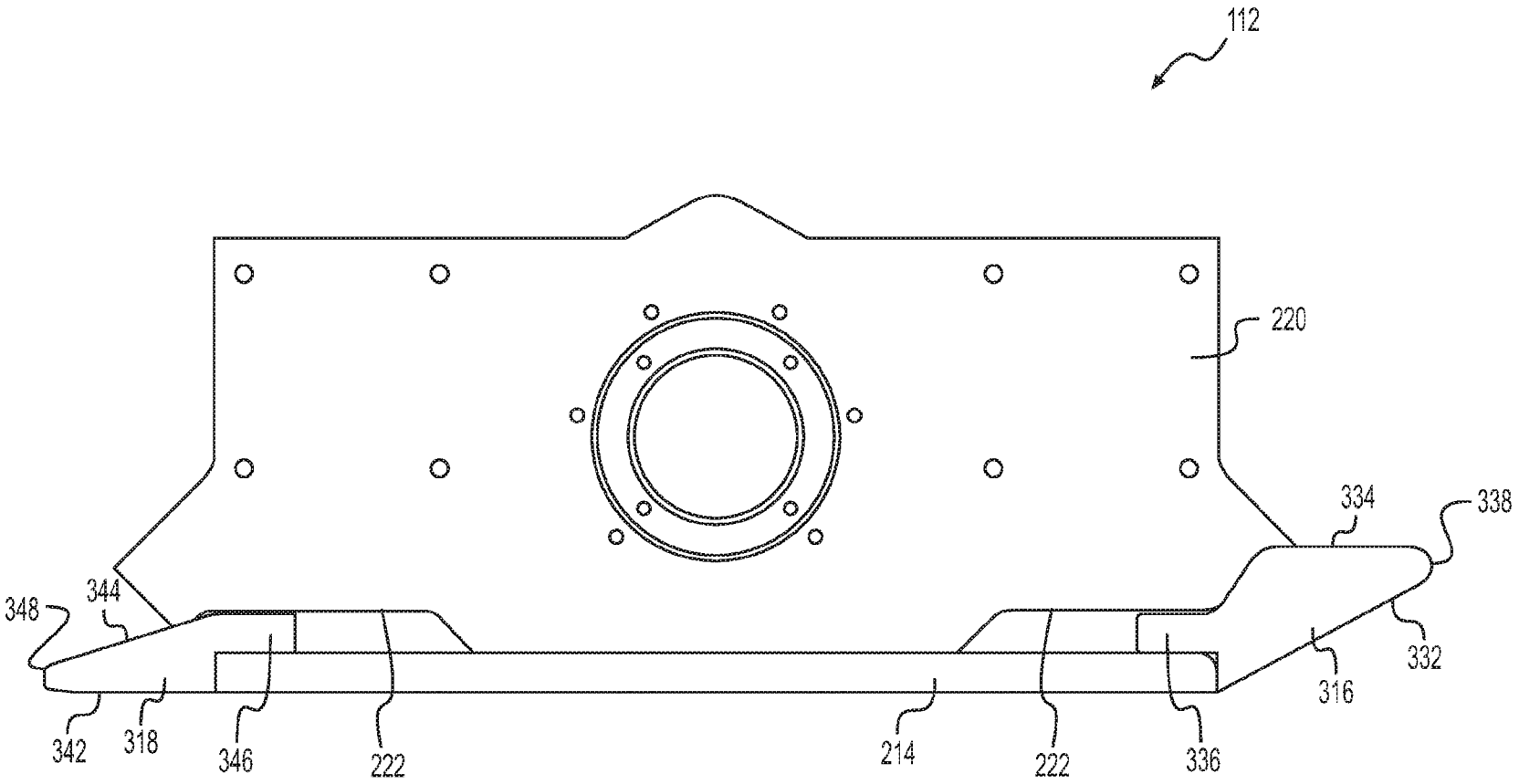
FIG. 3 is a side elevation view of a vibratory plate compactor attachment according to another exemplary embodiment of this disclosure.

In an alternative embodiment shown in FIG. 3, the geometric profile of a leading edge piece 316 may be different from the geometric profile of a trailing edge piece 318. In this embodiment, a lower edge 332 of the leading edge piece 316 slopes upward and outward from the leading edge of the central plate 214, and a lower edge 342 of the trailing edge piece 318 extends outward substantially parallel to a lower surface of the central plate 214. The interchangeability of the leading and trailing edge pieces joined to the standard central plate 214 facilitates configuration of the vibratory compactor attachment 112 such that the attachment can perform different operations in the forward and rearward directions of movement. Forward movement of the vibratory plate compactor attachment shown in FIG. 3 results in dirt or other surface material being directed underneath the central plate 214 by the upward and outward sloping lower edge 332 of the leading edge piece 316. The lower edge 332 of the leading edge piece 316 merges into a leading edge nose 338 and a flat upper edge 334. The configuration and dimensions of the leading edge piece 316 may be selected to facilitate this operation of directing material for compaction underneath the central plate 214. Similar to the embodiment shown in FIG. 2, an extension 336 of the leading edge piece 316 opposite from the leading edge nose 338 may be configured to fit in between an upper surface of the central plate 214 and a forward-facing, notched portion 222 of the mounting frame 220, in what amounts to essentially a tongue and groove or mortise and tenon type of attachment to the compactor frame 220.

The lower edge 342 of the trailing edge piece 318 extends outwardly substantially parallel to the lower surface of the central plate 214 and merges into a trailing edge nose 348 and a sloped upper edge 344. An extension 346 of the trailing edge piece 318 opposite from the trailing edge nose 348 may be configured to fit in between an upper surface of the central plate 214 and a rearward-facing, notched portion 222 of the mounting frame 220. In this configuration, the trailing edge piece 318 may be configured to act as a scraper, smoother, and leveler of the material following compaction by the central plate 214 as the vibratory compactor attachment is moved in a forward direction (to the right in FIG. 3). The trailing edge piece 318 is designed in this embodiment to leave a better surface finish following compaction than may be obtained without the scraping feature. One of ordinary skill in the art will recognize that the upward slope of the lower edge 332 on the leading edge piece 316, and the level configuration of the lower edge 342 on the trailing edge piece 318, as well as the overall dimensions and configurations of the leading and trailing edge pieces may be varied depending on a number of different factors including the type of material being compacted, the condition of the surface being compacted, and other factors. As one exemplary variation to the configuration of the trailing edge piece 318 in FIG. 3, the lower edge 342 may be provided with a slightly downward sloped portion extending slightly below the plane of the central plate 214 to further assist with the scraping and leveling function. The lower edge 332, 342 of a leading edge piece and/or a trailing edge piece 316, 318, respectively, in conjunction with the leading edge nose or trailing edge nose 338, 348 may be configured to at least one of direct material to be compacted by the vibratory plate compactor underneath the base plate, smooth material compacted by the base plate, or provide a variation to a profile of the at least one of a leading edge and a trailing edge of the base plate. As with the embodiment shown in FIG. 2, the leading and trailing edge pieces 316, 318 of the exemplary embodiment shown in FIG. 3 may be joined to the central base plate 214 to form a base plate assembly before installation on the mounting frame 220 of the vibratory plate compactor 112. Methods of joining the leading and trailing edge pieces 316, 318 may include welding, or the use of readily detachable fasteners such as bolts.

In the exemplary embodiment of FIG. 3, the base plate assembly including the central plate 214 and leading and trailing edge pieces 316, 318 ensures that dirt or other material being compacted is directed underneath the central plate 214 as the vibratory plate compactor 112 is moved in a forward direction (to the right in FIG. 3), while the trailing edge piece 318 scrapes and levels the material following compaction by the central plate 214 as the vibratory plate compactor continues to move in the forward direction. An operator of the excavator 100 may also move the vibratory plate compactor attachment 112 of the embodiment shown in FIG. 3 in the rearward direction (to the left in FIG. 3) to scrape and level the surface material before or after compaction with the vibratory motion of the central plate 214.

As an operator of the excavator 100 moves the vibratory plate compactor attachment 112 in a direction parallel to the axis of the compactor attachment, the vibratory mechanism 116 continues to operate to impart a vibratory up-and-down motion to the base plate assembly. Dirt or other material on the surface being compacted is directed underneath the central plate 214 by the leading edge piece 316 as the compactor attachment is moved forward, and the surface is scraped and leveled by the trailing edge piece 318 as the compactor attachment continues to be moved forward. The interchangeable leading edge piece 316 may be a single piece or a plurality of pieces extending and joined along substantially the entire length of the leading edge of the central plate 214. Similarly, the interchangeable trailing edge piece 318 may be a single piece or a plurality of pieces extending and joined along substantially the entire length of the trailing edge of the central plate 214. The leading and trailing edge pieces in the embodiment of FIG. 3 have different geometric profiles in a plane parallel to an axis of the compactor extending in a direction that the compactor is moved during use.

Figure 4:
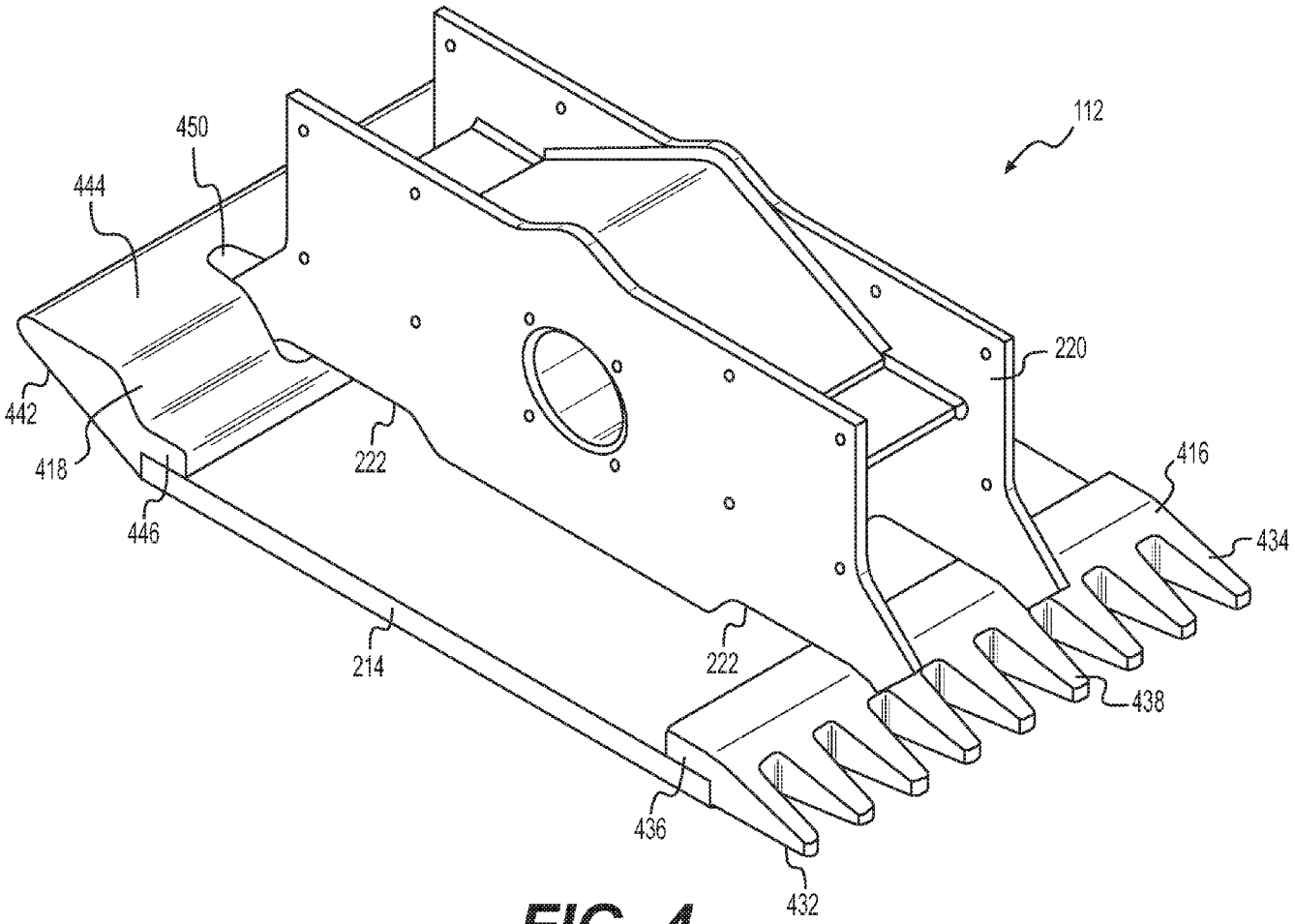
FIG. 4 is a perspective view of a vibratory plate compactor attachment according to yet another exemplary embodiment of this disclosure.
Figure 5:
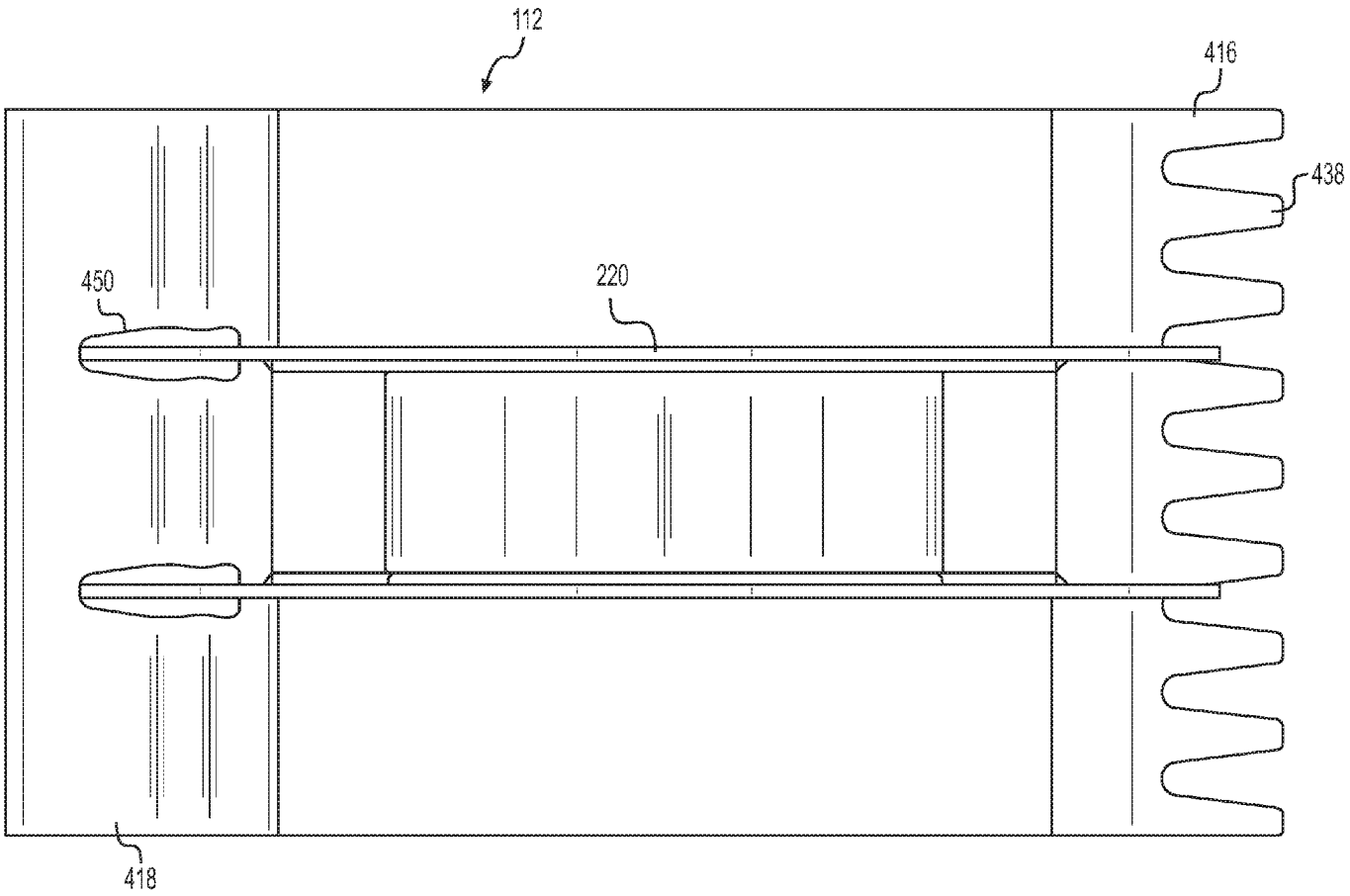
FIG. 5 is a top plan view of the embodiment of a vibratory plate compactor attachment shown in FIG. 4.

FIGS. 4 and 5 illustrate another alternative embodiment of a vibratory plate compactor 112, with the leading edge piece 416 being a single piece extending along and joined to the leading edge of the central plate 214, and with the leading edge piece 416 including a plurality of teeth defining the leading edge nose 438. A lower edge 432 of the leading edge piece 416 may be sloped upward and outward from the central plate 214 along the bottom side of each tooth portion, or the upper edge 434 of the leading edge piece 416 may be sloped downward and outward to form each of the tooth portions. Alternatively, both the lower edge 432 and the upper edge 434 of the leading edge piece 416 may be sloped obliquely relative to parallel lower and upper surfaces of the central plate 214. The plurality of teeth defining the leading edge nose 438 in the exemplary embodiment of FIG. 4 are configured to assist with the breaking up and directing of material to be compacted underneath the central plate 214 as the vibratory plate compactor attachment 112 is moved in a forward direction (to the right in FIG. 4). In a variation to the alternative embodiment of FIG. 4, the toothed leading edge nose 438 may be formed by a plurality of separate ground engagement teeth, similar to the way in which ground engagement tools are attached along a leading edge of a bucket on a bulldozer.

The trailing edge piece 418 of the exemplary embodiment shown in FIGS. 4 and 5 is configured such that the lower edge 442 slopes upward and outward from the trailing edge of the central base plate 214. One of ordinary skill in the art will recognize that alternative implementations may include providing an interchangeable trailing edge piece that extends outward from the trailing edge of the central plate 214 and parallel or sloped downward relative to the lower surface of the central plate 214. Both the leading edge piece 416 and the trailing edge piece 418 may be interchangeably fastened to the central base plate 214 and the compactor mounting frame 220 through the extensions 436, 446, and the forward and backward facing notched portions 222 of the mounting frame 220. As shown in FIG. 5, the mounting frame 220 may also include front arm portions that extend forward over a portion of the upper edge 434 of the leading edge piece 416, and rear arm portions that extend rearward over a portion of the upper edge 444 of the trailing edge piece 418. The rear arm portions of the mounting frame 220 may extend at least partially through openings 450 formed in the trailing edge piece 418 to provide additional stability and interconnecting interfaces between the trailing edge piece 418 and the mounting frame 220. Similarly, the front arm portions of the mounting frame 220 extending forward over a portion of the upper edge 434 of the leading edge piece 416 provide additional stability and interconnecting interfaces between the leading edge piece 416 and the mounting frame 220.

Methods of configuring a base plate assembly according to various implementations of this disclosure may include joining the leading and trailing edge pieces to the planar, rectangular-shaped central plate by known welding techniques, or with fasteners, and then attaching the base plate assembly to the mounting frame 220 of the vibratory plate compactor 112. Alternatives may include locking the planar central plate to the mounting frame 220 of the vibratory plate compactor before inserting and joining the one or more leading edge pieces and trailing edge pieces between the leading and trailing edges of the central plate and the mounting frame 220. An exemplary implementation of these methods is discussed in the following section.

INDUSTRIAL APPLICABILITY

Operability, serviceability, and manufacturability of a base plate assembly for a vibratory plate compactor attachment may be enhanced by providing a removable base plate assembly that includes interchangeable leading and trailing edge pieces configured to be joined along leading and trailing edges of a central, planar, rectangular-shaped base plate. Conventional methods for manufacturing a removable base plate for a vibratory plate compactor generally involve forming a one piece base plate from a relatively thick plate of metal ranging in thickness from approximately 25-30 mm. The removable base plate is formed with a configuration including at least a leading edge that curves upward to allow dirt or other materials being compacted to be guided underneath the base plate as the vibratory plate compactor is moved along the surface. The relatively thick base plate is generally made longer than its final length in order to provide extra material along the leading and trailing edges that can be bent upward and then trimmed to the desired final dimensions for the base plate. This process for forming the base plate results in wasted material, and the process of bending the leading and trailing edges can be a difficult manufacturing operation involving large forces and the inability to precisely control the finished geometry and dimensions of the base plate. Improvements to vibratory plate compactors according to the various embodiments and implementations of this disclosure are achievable by providing interchangeable edge pieces that may be selectively joined to one or both of the leading and trailing edges of a planar, standardized, central plate.

A method of configuring a base plate assembly for a vibratory plate compactor 112 according to one exemplary implementation of this disclosure includes providing a planar, central plate configured for compacting earth, and fastening at least one interchangeable edge piece along at least one of a leading edge and a trailing edge of the central plate. The assembly of the central plate and the leading and trailing edge pieces may be attached to a mounting frame of the vibratory plate compactor.

One exemplary method of configuring the base plate assembly includes fastening a first edge piece to extend along substantially an entire length of the leading edge of the central plate, and fastening a second edge piece to extend along substantially an entire length of the trailing edge of the central plate. In some implementations, the central plate may be rectangular-shaped, while in other variations the central plate may have other configurations. Alternative implementations may include fastening a plurality of first edge pieces along the length of the leading edge of the central plate, and/or fastening a plurality of second edge pieces along the length of the trailing edge of the central plate. As shown in FIG. 2, the first and second edge pieces 216, 218 may be provided with the same geometric profile in a plane parallel to an axis of the base plate assembly extending in a direction that the vibratory plate compactor is moved during use.

Further alternative implementations of a method of configuring a base plate assembly according to this disclosure may include fastening one or more first edge piece to extend along substantially an entire length or along part of the length of the leading edge of the central plate, and fastening one or more second edge piece to extend along substantially an entire length or along part of the length of the trailing edge of the central plate. As shown in the exemplary embodiments of FIGS. 3-5, the first and second edge pieces may have different geometric profiles in a plane parallel to an axis of the base plate assembly extending in a direction that the vibratory plate compactor is moved during use. Additionally, as shown in the embodiment of FIGS. 4 and 5, additional features may be provided along the leading edge piece 416 or trailing edge piece 418, such as the plurality of teeth defining the leading edge nose 438 of the leading edge piece 416. The interchangeable edge pieces provide the flexibility to incorporate different functional aspects and improve the performance of the vibratory plate compactor. The interchangeable edge pieces may also provide improved manufacturability, increased life span, and reduced material costs for the removable base plate assembly. The interchangeable edge pieces also allow for the use of many of the same ground engagement tools with the vibratory plate compactor as are currently used with other earth moving machines such as bulldozers, excavators, and front end loaders.

It will be apparent to those skilled in the art that various modifications and variations can be made in the disclosed exemplary embodiments and configurations of a vibratory plate compactor and removable base plate assembly without departing from the scope of the disclosure. Other embodiments of the removable base plate assembly for a vibratory plate compactor will be apparent to those skilled in the art from consideration of the specification and practice of the apparatus and methods disclosed herein. It is intended that the specification and examples be considered as exemplary only, with a true scope of the disclosure being indicated by the following claims and their equivalents.

What is claimed is:

1. An interchangeable edge piece configured to be joined to a base plate of a vibratory plate compactor, the interchangeable edge piece comprising:

an interface edge, a lower edge, a nose, and an upper edge;

the interface edge having a configuration adapted to mate with at least one of a leading edge and a trailing edge of the base plate; and the lower edge configured to extend outward from the interface edge to the nose, and in conjunction with the nose, at least one of direct material to be compacted by the vibratory plate compactor underneath the base plate, smooth material compacted by the base plate, or provide a variation to a profile of the at least one of a leading edge and a trailing edge of the base plate, wherein the interface edge includes an extension configured to mate with a notch in a mounting frame of the vibratory plate compactor.

2. The interchangeable edge piece of claim 1, wherein the lower edge is configured to extend outward and upward from the at least one of the leading edge and the trailing edge of the base plate, oblique to a lower surface of the base plate.

3. The interchangeable edge piece of claim 1, wherein the lower edge is configured to extend outward and substantially parallel to a lower surface of the base plate.

* * * * *